US005752801A

United States Patent [19]

Kennedy

[11] Patent Number: 5,752,801

[45] Date of Patent: May 19, 1998

[54] APPARATUS FOR COOLING A GAS TURBINE AIRFOIL AND METHOD OF MAKING SAME

[75] Inventor: Mark Thomas Kennedy, Oviedo, Fla.

[73] Assignee: Westinghouse Electric Corporation, Pittsburgh, Pa.

[21] Appl. No.: 803,299

[22] Filed: Feb. 20, 1997

[51] Int. Cl.[6] ..... F04D 29/58

[52] U.S. Cl. ..... 415/115; 416/97 R

[58] Field of Search ..... 416/95, 96 R, 416/96 A, 97 R; 415/115, 116

[56] References Cited

U.S. PATENT DOCUMENTS

| | | | |
|---|---|---|---|
| 3,834,831 | 9/1974 | Mitchell | 416/95 |
| 4,073,599 | 2/1978 | Allen et al. | 416/97 R |
| 4,292,008 | 9/1981 | Grosjean et al. | 415/115 |
| 4,456,428 | 6/1984 | Cuvillier | 416/97 R |
| 4,474,532 | 10/1984 | Pazder | 416/97 R |
| 4,930,980 | 6/1990 | North et al. | 415/115 |
| 4,962,640 | 10/1990 | Tobery | 60/39.02 |
| 5,117,626 | 6/1992 | North et al. | 60/39.75 |
| 5,145,315 | 9/1992 | North et al. | 415/115 |
| 5,288,207 | 2/1994 | Linask | 416/97 R |
| 5,472,316 | 12/1995 | Taslim et al. | 416/96 R |
| 5,601,399 | 2/1997 | Okpara et al. | 416/96 R |

OTHER PUBLICATIONS

Han, J.C. et al., "Effect of Rib–Angle Orientation on Local Mass Transfer Distribution in a Three–Pass Rib–Roughened Channel", American Society of Mechanical Engineers, Presented at the Gas Turbine and Aeroengine Congress and Exposition (Toronto, Ontaria, Canada), 1989, 1–9.

Lau, S.C. et al., "Heat Transfer Characteristics of Turbulent Flow in a Square Channel with Angled Discrete Ribs", American Society of Mechanical Engineers, Presented at the Gas Turbine and Aeroengine Congress and Exposition (Brussels, Belgium), 1990, 1–9.

*Primary Examiner*—John T. Kwon

[57] ABSTRACT

An airfoil for use in a turbomachine such as a stationary vane in a gas turbine. The airfoil has a plurality of longitudinally extending ribs in its trailing edge region that form first cooling fluid passages extending from the airfoil cavity to the trailing edge of the airfoil. The first cooling fluid passages are tapered so that their height and width decrease as they extend toward the trailing edge. Turbulating fins are spaced along the length of each passage to increase the heat transfer. The ribs have a plurality of radially extending passages spaced along their length so as to form an array of interconnected longitudinal and radial passages. The airfoil is formed by a casting process using a core that has longitudinal and radial fingers that correspond to the longitudinal and radial passages of the airfoil.

19 Claims, 5 Drawing Sheets

APPARATUS FOR COOLING A GAS TURBINE AIRFOIL AND METHOD OF MAKING SAME

BACKGROUND OF THE INVENTION

The present invention relates to an airfoil, such as that used in the stationary vane of a gas turbine. More specifically, the present invention relates to an apparatus for cooling an airfoil.

A gas turbine employs a plurality of stationary vanes that are circumferentially arranged in rows in a turbine section. Since such vanes are exposed to the hot gas discharging from the combustion section, cooling of these vanes is of the utmost importance. Typically, cooling is accomplished by flowing cooling air through one or more cavities formed inside the vane airfoil.

According to one approach, cooling of the vane airfoil is accomplished by incorporating one or more tubular inserts into each of the airfoil cavities so that passages surrounding the inserts are formed between the inserts and the walls of the airfoil. The inserts have a number of holes distributed around their periphery that distribute the cooling air around these passages.

According to another approach, each airfoil cavity includes a number of radially extending passages, typically three or more, forming a serpentine array. Cooling air, supplied to the vane outer shroud, enters the first passage and flows radially inward until it reaches the vane inner shroud. A first portion of the cooling air exits the vane through the inner shroud and enters a cavity located between adjacent rows of rotor discs. The cooling air in the cavity serves to cool the faces of the discs. A second portion of the cooling air reverses direction and flows radially outward through the second passage until it reaches the outer shroud, whereupon it changes direction again and flows radially inward through the third passage, eventually exiting the blade from the third passage through longitudinally extending holes in the trailing edge of the airfoil. Various methods have been tried to increase the effectiveness of the cooling air flowing through the serpentine passages. One such approach involves the use of fins extending from the walls that form the passages. The use of both fins that extend perpendicular to the direction of flow and fins that are angled to the direction of flow have been tried.

Cooling of the trailing edge portion of the vane is especially difficult because of the thinness of the trailing edge portion, as well as the fact that the cooling air has often undergone considerable heat up by the time it reaches the trailing edge. Traditionally, the cooling air is discharged from the vane internal cavity into the hot gas flow path by longitudinally oriented passages in the trailing edge of the airfoil. In order to increase the heat transfer efficiency, a pin-fin array has been incorporated in the trailing edge passages. In another approach, proposed for use in closed loop cooling systems, the cooling air is directed through span-wise radial holes extending between the inner and outer shrouds.

One potential solution to the problem of cooling the trailing edge portion of the vane airfoil is to dramatically increase the cooling air supplied to the airfoil, thereby increasing the flow rate of the cooling air flowing through the passages. However, such a large increase in cooling air flow is undesirable. Although such cooling air eventually enters the hot gas flowing through the turbine section, little useful work is obtained from the cooling air, since it was not subject to heat up in the combustion section. Thus, to achieve high efficiency, it is crucial that the use of cooling air be kept to a minimum.

Another potential solution to the problem of cooling the trailing edge portion of the airfoil is to use more complex geometry in the trailing edge cooling air passages. However, such complex geometry makes manufacture of the vane airfoil, which is typically cast, more difficult.

It is therefore desirable to provide a cooling scheme that significantly increases the cooling effectiveness of the cooling air flowing through the airfoil in a gas turbine, and to provide a method of manufacturing such an airfoil.

SUMMARY OF THE INVENTION

Accordingly, it is the general object of the current invention to provide a cooling scheme that significantly increases the cooling effectiveness of the cooling air flowing through the airfoil in a gas turbine, and to provide a method of manufacturing such an airfoil.

Briefly, this object, as well as other objects of the current invention, is accomplished in an airfoil for use in a turbomachine, comprising (i) first and second side walls, the sidewalls forming leading and trailing edges, and (ii) a plurality of ribs extending between the first and second side walls in a region of the airfoil adjacent the trailing edge, each of the ribs being spaced apart in the radial direction so as to form a plurality of first cooling fluid passages, each of the first passages separated by one of the ribs, each of the ribs having a plurality of second passages formed therein, each of the second passages placing two adjacent first passages in flow communication, whereby the ribs form an array of interconnected first and second cooling fluid passages.

In a preferred embodiment of the invention, the first passages are tapered in both their height and width as they extend longitudinally toward the trailing edge of the airfoil and have a plurality of turbulating fins spaced along their length.

The invention also encompasses a method of making an airfoil for use in a turbomachine, comprising the steps of (i) forming a core, at least a portion of the core forming a lattice structure comprised of interconnected fingers extending in first and second substantially mutually perpendicular directions, and (ii) pouring a molten material around the core so that the fingers forms an array of interconnected passages extending in the first and second directions.

DESCRIPTION OF THE PREFERRED EMBODIMENT

Figure 1:
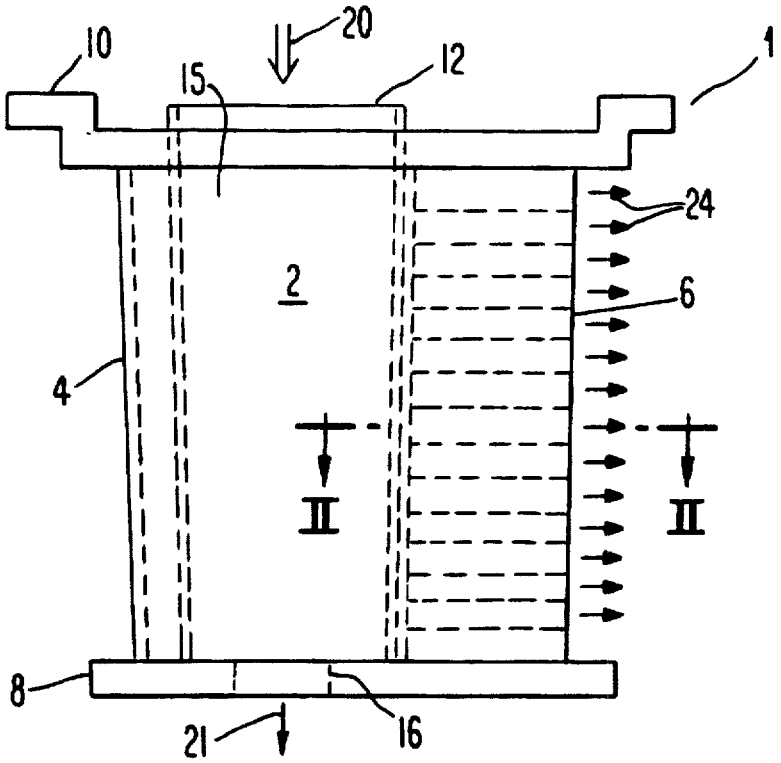
FIG. 1 is an elevation of a gas turbine vane having an airfoil according to the current invention.

Referring to the drawings, there is shown in FIG. 1 a stationary vane 1, such as that used in the turbine section of a gas turbine. As is conventional, the vane 1 is comprised of an airfoil 2 having inner and outer shrouds 8 and 10 formed on its ends. The side walls 18 and 19 of the airfoil 2, shown in FIG. 2, form leading and trailing edges 4 and 6, respectively.

Figure 2:
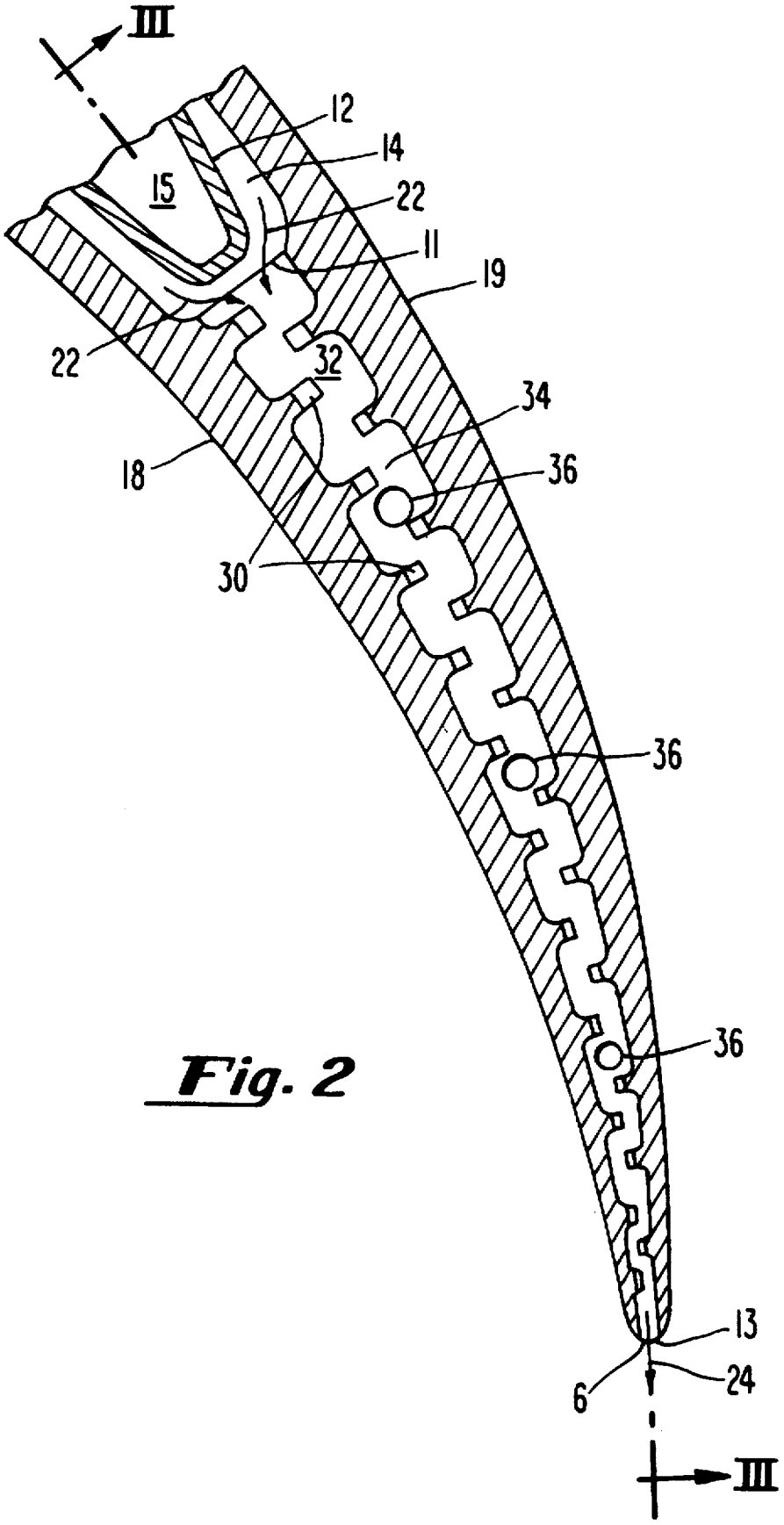
FIG. 2 is a cross-section taken through line II—II shown in FIG. 1. For purposes of clarification, line II—II is also shown in FIG. 4.

The side walls 18 and 19 also form a cavity 14 in the central portion of the airfoil 2, as shown best in FIG. 2. An insert 12 is disposed in the cavity 14. As shown in FIG. 1, cooling air 20, which is typically bled from the compressor section of the gas turbine, is directed through a passage 15 in the insert 12. The passage 15 directs a first portion of the cooling air 20 radially through the vane 1 so that it exits through an opening 16 formed in the inner shroud 8. Using techniques well known in the art, a plurality of holes (not shown) are formed in the insert 12 that serve to distribute a second portion 22 of the cooling air 20 through the passage formed between side walls 18, 19 and the insert, thereby cooling the portion of the side walls adjacent the leading edge, as well as the central portion of the side walls.

According to the current invention, after exiting the cavity 14, the cooling air 22 flows between the portions of the side walls 18 and 19 adjacent the trailing edge 6, thereby cooling that portion of the airfoil 2. As shown in FIGS. 2–5, a number of substantially parallel ribs 34 extend transversely between the side walls 18 and 19 and extend longitudinally from the cavity 14 to the trailing edge 6. (As used herein, the term longitudinal refers to a direction generally following along the curvature of the airfoil from the leading to the trailing edges. The term transverse refers to a direction that is generally perpendicular to a side wall of the airfoil.) The ribs 34 form an array of substantially parallel longitudinally extending passages 32 between the side walls 18 and 19 that extend from the cavity 14 to the trailing edge 6, with the inlet 11 of each passage being located at the cavity and the outlet 13 being located at the trailing edge.

Figure 4:
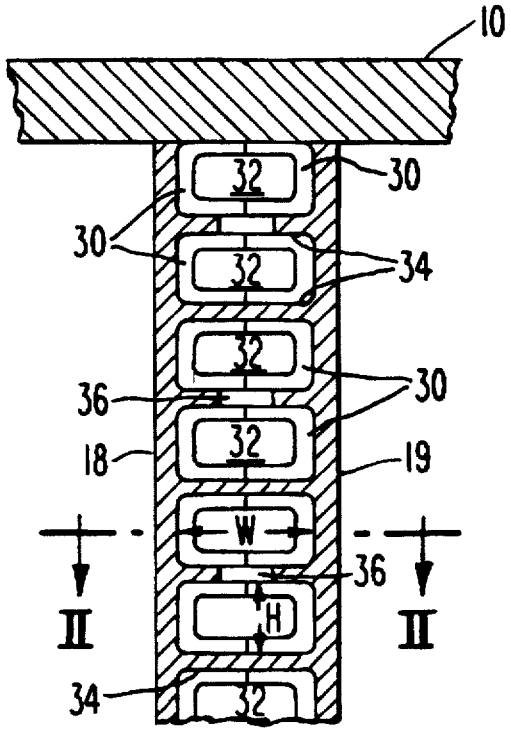
FIG. 4 is a cross-section taken through line IV—IV shown in FIG. 3.

As shown in FIG. 4, in the preferred embodiment of the invention, each passage 32 is approximately rectangular in cross-section and has a height H in the radial direction and a width W in the transverse direction. (As used herein, the term radial refers to a direction that is generally perpendicular to the longitudinal direction and that would approximately radiate outward from the axis of the rotor when the airfoil is installed in a gas turbine.) However, in some embodiments, the passages 32 may be circular in cross-section over their entire length, or they may initially be rectangular but transition into circular cross-sections as they reach the trailing edge outlets 13.

The passages 32 are preferably relatively long and narrow. In one embodiment of the invention, the length of the passages is over 4.5 cm (1.75 inches) but the maximum height and width of most of the passages is no more than 0.25 cm (0.1 inch). As will be discussed below, the current invention encompasses a novel method for manufacturing such long, narrow cooling air passages 32.

As shown in FIG. 2, according to an important aspect of the current invention, the passages 32 are tapered in the transverse direction as they extend longitudinally toward the trailing edge 6. Thus, the width W of each passage 32 progressively decreases as it extends from its inlet 11 to its outlet 13. In one embodiment of the invention, the width W of the passages 32 is reduced at least approximately 50% from the inlets 11 to the outlets 13.

Further, in the preferred embodiment of the invention, each passage 32, except the passages directly adjacent to the inner and outer shrouds 8 and 10, is also tapered in the radial direction as its extends longitudinally toward the trailing edge 6 so that its height H progressively decreases as it extends from its inlet 11 to its outlet 13. In some embodiments of the invention, the height H of such passages 32 is reduced at least approximately 10%, and may be reduced as much as 30% or more, from the inlets 11 to the outlets 13.

Figure 5:
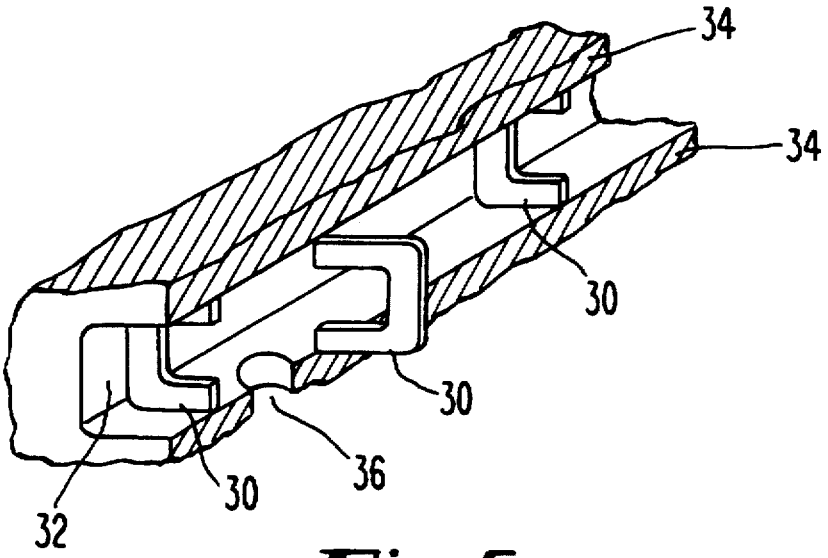
FIG. 5 is an isometric view of a portion of a longitudinal cross-section through one of the cooling air passages shown in FIGS. 2–4.

According to another important aspect of the invention, a number of turbulating fins 30 are spaced along the length of each passage 32. As shown best in FIGS. 4 and 5, each turbulating fin 30 is approximately C-shaped and projects into a passage 32 from one of the passage side walls. As shown in FIGS. 2 and 5, the turbulating fins 30 are staggered so that as the cooling air 22 flows along the length of the passage 32, each successive turbulating fin it encounters is formed on an opposite side wall from the previous turbulating fin. In one embodiment of the invention, the turbulating fins 30 project into the passages 32 approximately 0.025 cm (0.01 inch) and are longitudinally spaced approximately 0.25 cm (0.10 inch) apart.

According to another important aspect of the invention, a number of radially extending passages 36 are spaced along the length of each rib 34 to facilitate manufacturing of the airfoil 2, as discussed further below. Preferably, the radial passages 36 are spaced along the ribs 34 so as to be staggered with respect to the radial passages in the adjacent ribs, as shown best in FIG. 3. Thus, the radially passages 36 in adjacent ribs 34 will not be radially aligned.

Figure 3:
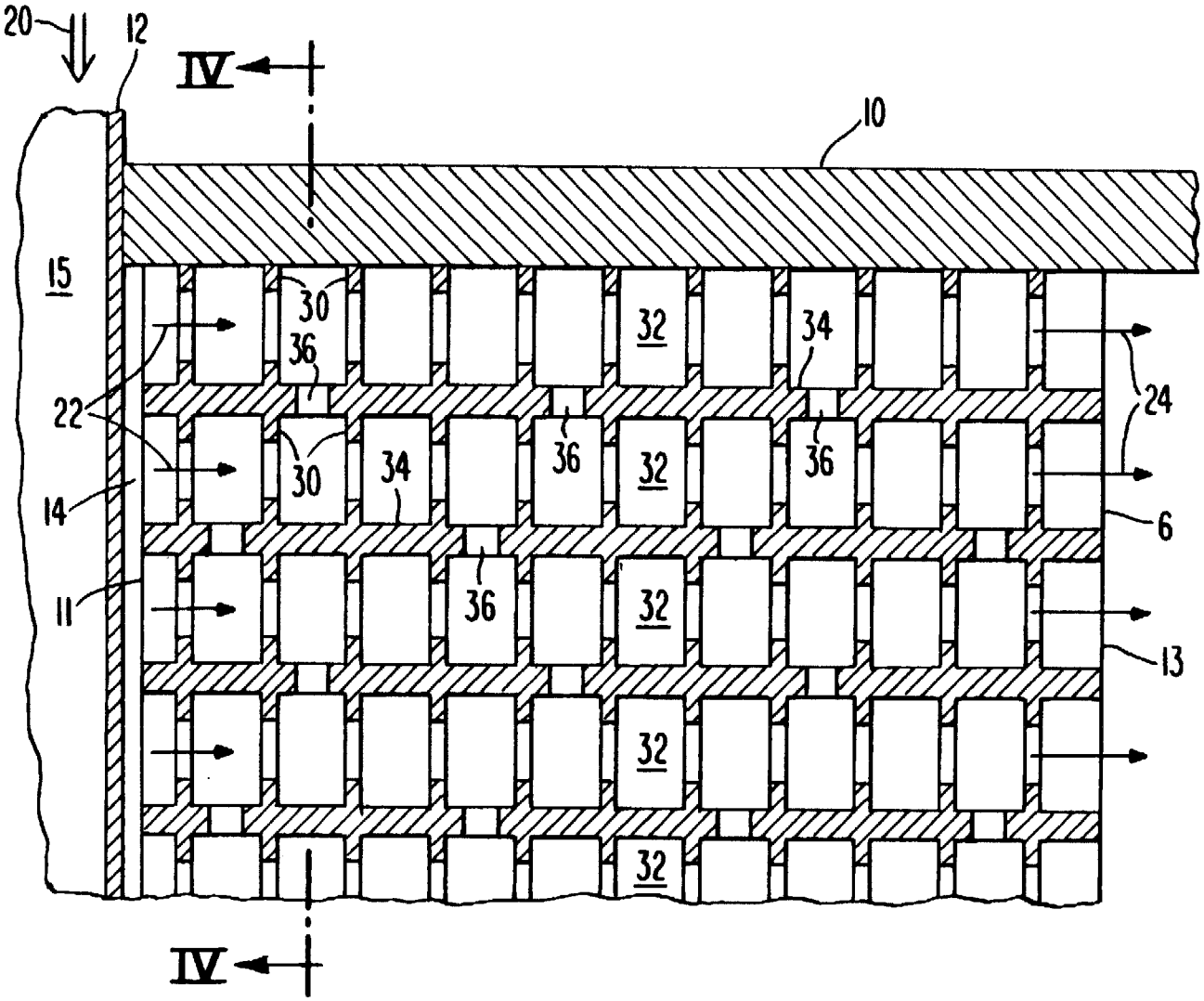
FIG. 3 is a cross-section taken through line III—III shown in FIG. 2.

As also shown best in FIG. 3, the longitudinally and radially extending passages 32 and 36, respectively, form an array of interconnected passages extending in mutually perpendicular directions.

In operation, the cooling air 22 from the cavity 14 is distributed to the inlets 11 of the each of the passages 32. The cooling air 22 then flows along the length of each passage 32 toward the outlets 13. The turbulating fins 30 induce turbulence that increases the heat transfer between the cooling air 22 and the walls of the passages 32. The tapering of the passages 32 ensures that the flow accelerates, thereby further ensuring good heat transfer. Thus, the cooling air 22 is able to effectively cooling the portion of the airfoil 2 adjacent the trailing edge 6, thereby allowing the amount of cooling air utilized to be kept to a minimum so as to maximize the performance of the gas turbine. After flowing through the passages 32, the streams of cooling air 24 are ejected from the vane 1 through the passage outlets 13 formed at the trailing edge 6.

The radial passages 36 in the ribs allow cooling air 22 to communicate between adjacent passages 32. However, since such flow communication may be undesirable in certain designs, the diameter of the passages 36 can be sized to the minimum necessary to provide sufficient core strength during casting, as discussed below, so as to minimize such flow communication.

Figure 6:
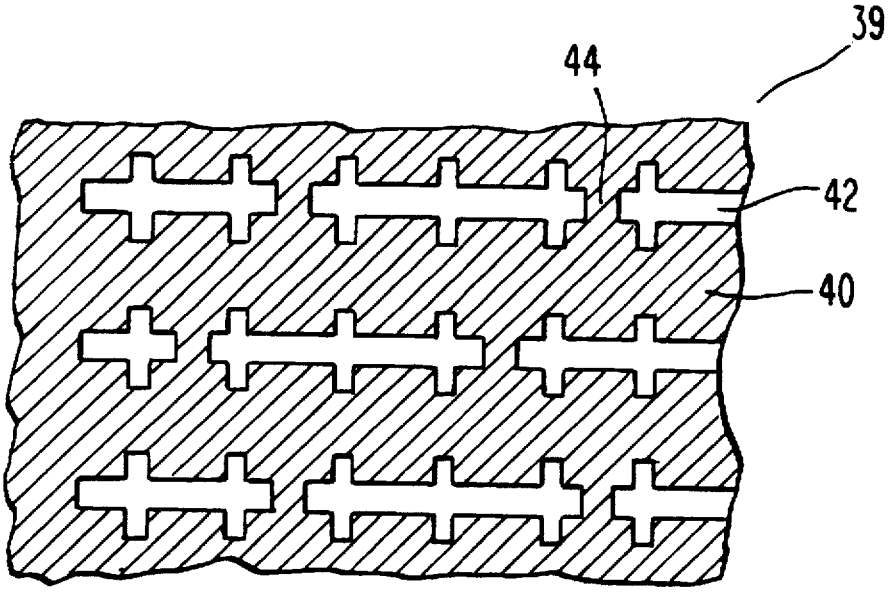
FIG. 6 is a cross-section taken through the casting core used to make the airfoil shown in FIGS. 1–4.

In the preferred embodiment of the invention, the airfoil 2 is made by a casting process. As is well know in the art, such casting is effected by forming a die or mold having the general shape of the side walls 18 and 19. A core 39, a portion of which is shown in FIG. 6, is inserted into the portion of the die that will ultimately form the trailing edge portion of the airfoil. Molten material, which is typically metallic, is then poured into the die and around the core 39 so as to form the airfoil geometry.

The core 39 is preferably formed from a ceramic material. The core 39 is the inverse of the internal structure of the airfoil 2 in the region adjacent the trailing edge 6. Thus, longitudinal fingers 40 are formed in the core 39 that have the size, shape, and location of the longitudinal passages 32. In addition, radial fingers 44 are formed that have the size, shape, and location of the radial passages 36. Similarly, passages 42 are formed in the core 39 that have the size, shape, and location of the ribs 34 and turbulating fins 30. Thus, the core 39 forms a lattice-work of interconnected longitudinally and radially extending fingers 40 and 44, respectively, that correspond to the array of interconnected longitudinally and radially extending passages 32 and 36, respectively.

In the preferred embodiment of the invention, the longitudinal passages 32 directly adjacent to the inner and outer shrouds 8 and 10 are wider than the other passages at their inlets 11 and, as previously discussed, are not tapered with respect to their height. Consequently, the uppermost and innermost longitudinal fingers 40 of the core 39 are thicker than the intermediate longitudinal fingers. This imparts additional strength and stiffness to the core 39.

According to an important aspect of the current invention, the presence of the radially extending fingers 44, which form the radial passages 36 and, more importantly for present purposes, interconnect the longitudinally extending fingers 40, provides sufficient stiffness and strength in the core 39 to allow the casting of the long, narrow and geometrically complex passages 32. Consequently, depending on the particular design, the size of the radial fingers 44 may be minimized based on the minimum strength requirements of the core 39. In one embodiment of the invention, the radial fingers 44 have a diameter of approximately 0.1 cm (0.05 inch).

Figure 8:
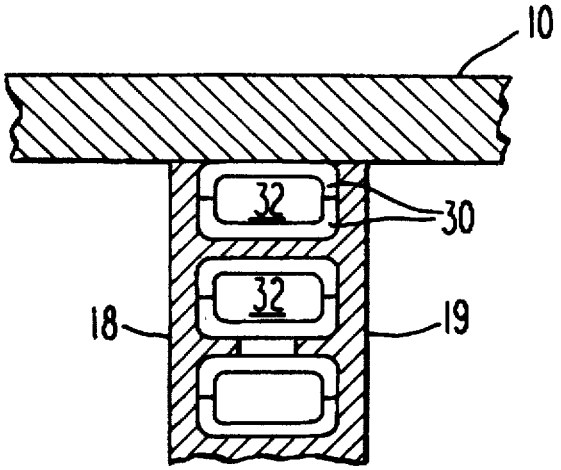
FIG. 8 is a cross-section taken through line VIII—VIII shown in FIG. 7.
Figure 7:
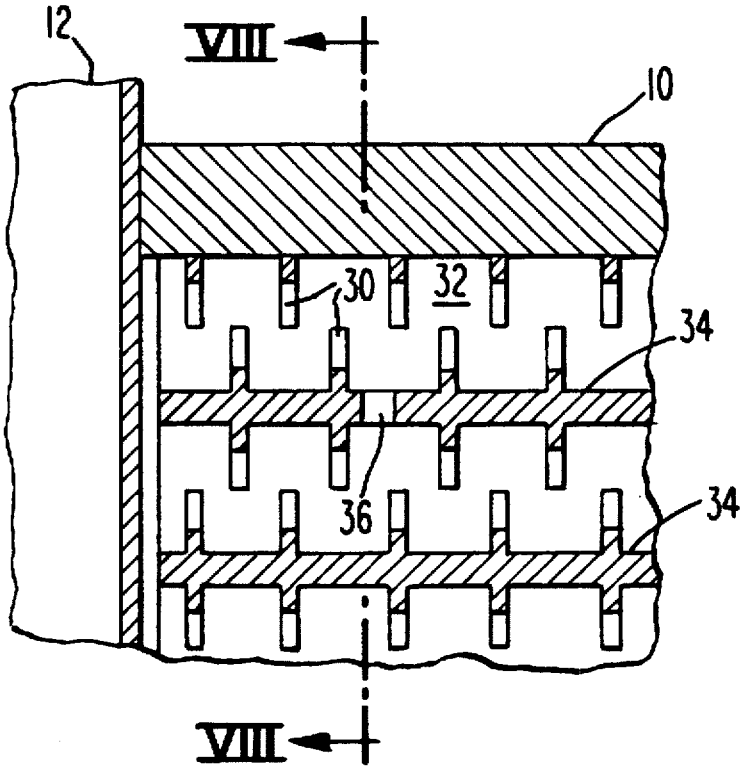
FIG. 7 is a view similar to FIG. 3 showing an alternate embodiment of the current invention.

FIGS. 7 and 8 show an alternate embodiment of the invention in which the turbulating fins 30 project from the upper and lower walls of the longitudinal passages 32, as shown in FIG. 8, and are staggered in the manner shown in FIG. 7.

Although the present invention has been discussed with reference to cooling air passages in the airfoil of a stationary vane for a gas turbine, the invention is also applicable to other types of airfoils, such as those used in rotating blades, as well airfoils that are used in other types of turbomachines, such as steam turbines, or that have internal passages that serve a purpose other than cooling. Consequently, the present invention may be embodied in other specific forms without departing from the spirit or essential attributes thereof and, accordingly, reference should be made to the appended claims, rather than to the foregoing specification, as indicating the scope of the invention.

I claim:

1. An airfoil for use in a turbomachine, comprising:

a) first and second side walls, said sidewalls forming leading and trailing edges; and b) a plurality of ribs extending between said first and second side walls in a region of said airfoil adjacent said trailing edge, each of said ribs being spaced apart in the radial direction so as to form a plurality of first cooling fluid passages, each of said first passages separated by one of said ribs, each of said ribs having a plurality of second passages formed therein, each of said second passages placing two adjacent first passages in flow communication, whereby said ribs form an array of interconnected first and second cooling fluid passages.

2. The airfoil according to claim 1, further comprising a cavity for directing a flow of cooling fluid formed between said side walls, and wherein each of said first passages extend from said cavity to said trailing edge.

3. The airfoil according to claim 1, further comprising a plurality of fins projecting into each of said first passages.

4. The airfoil according to claim 1, wherein each of said first passages is tapered so as to reduce the dimensions of said passages in two mutually perpendicular directions each of which is perpendicular to the direction in which said first passages extend.

5. The airfoil according to claim 4, wherein each of said first passages has a height in the radial direction and a width in a direction perpendicular to the radial direction, and wherein said tapering of said first passages results in reductions in both said height and said width of said passages.

6. The airfoil according to claim 1, wherein said second passages are staggered between adjacent ribs, whereby said second passages are not radially aligned with respect to adjacent ribs.

7. The airfoil according to claim 1, wherein said airfoil is made by casting a molten metallic material around a core comprised of members interconnected so as to form a shape having the shape of said array of first and second cooling fluid passages.

8. An airfoil for use in a turbomachine, comprising:

a) first and second side walls, said sidewalls forming leading and trailing edges;

b) a first cooling fluid passage formed between said side walls, said first passage extending in a substantially radial direction; and c) a plurality of second cooling fluid passages formed between said side walls and extending toward said trailing edge, each of said passages being tapered as it extends toward said trailing edge so as to reduce the cross-sectional area thereof, each of said second passages in flow communication with said first passage, whereby said first passage supplies a flow of cooling fluid to said second passages.

9. The airfoil according to claim 8, wherein each of said second passages has a width in a direction perpendicular to the radial direction, and wherein said tapering of said second passages reduces said width of said passages as they extend toward said trailing edge.

10. The airfoil according to claim 8, wherein each of said second passages has a height in the radial direction, and wherein said tapering of said second passages reduces said height of said passages as they extend toward said trailing edge.

11. The airfoil according to claim 8, wherein each of said second passages has a height in the radial direction and a width in a direction perpendicular to the radial direction, and wherein said tapering of said second passages reduces both said height and said width of said second passages as they extend toward said trailing edge.

12. The airfoil according to claim 8, wherein each of said second passages has a length as it extends toward said trailing edge, and wherein a plurality of fins are spaced along said length of each of said second passages, each of said fins projecting into its respective passage.

13. The airfoil according to claim 12, wherein each of said fins projects in the radial direction.

14. The airfoil according to claim 12, wherein each of said fins is approximately C-shaped.

15. The airfoil according to claim 12, wherein each of said second passages have first and second opposing walls, and wherein a first portion of said fins project from said first wall, and a second portion of said fins project from said second wall.

16. The airfoil according to claim 15, wherein said fins are staggered, whereby each successive fin projects from an alternating one of said first and second walls.

17. The airfoil according to claim 8, wherein each of said second passages are separated by a rib, each of said ribs having a plurality of openings formed therein.

18. The airfoil according to claim 17, wherein each of said openings in said ribs places said second passages separated by said rib in flow communication.

19. The airfoil according to claim 17, wherein said airfoil is made by a casting process.

* * * * *